United States Patent [19]

Kussy

[11] 4,258,343

[45] Mar. 24, 1981

[54] UNITIZED COMBINATION STARTER

[75] Inventor: Frank W. Kussy, Randallstown, Md.

[73] Assignee: Gould Inc., Rolling Meadows, Ill.

[21] Appl. No.: 11,611

[22] Filed: Feb. 12, 1979

[51] Int. Cl.[3] ..... H01H 73/00; H01H 77/10

[52] U.S. Cl. ..... 335/6; 335/16; 335/195

[58] Field of Search ..... 335/6, 16, 195, 147

[56] References Cited

U.S. PATENT DOCUMENTS

| | | | |
|---|---|---|---|
| 3,987,382 | 10/1976 | Cataldo et al. | 335/6 |
| 4,031,492 | 6/1977 | Wafer | 335/16 |
| 4,039,983 | 8/1977 | Terracol et al. | 335/16 |

*Primary Examiner*—Harold Broome

*Attorney, Agent, or Firm*—Harold Huberfeld; Jerome M. Berliner; Bernard Gerb

[57] ABSTRACT

A unitized combination starter is constructed with circuit breaker and contactor sections, each of which is provided with a pair of spaced stationary contacts and a cooperating movable bridging contact. The bridging contacts are closely spaced, are parallel and carry currents which flow in opposite directions. Under severe fault conditions a strong blowoff effect is created to force both bridging contacts in their respective contact opening directions. This quickly places four air gaps in the current path to severely limit current rise and thereby facilitate circuit interruption.

10 Claims, 1 Drawing Figure

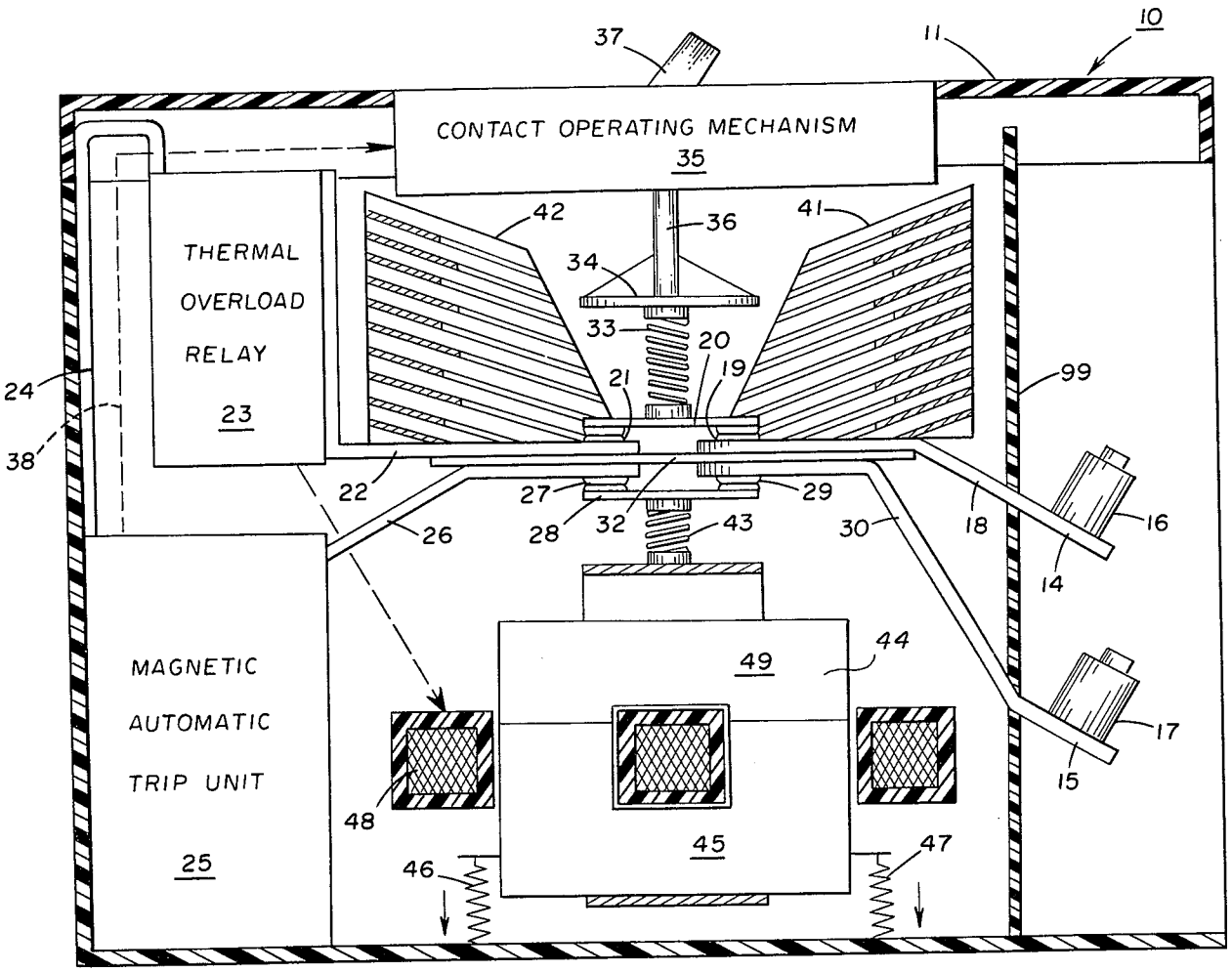
CONTACT OPERATING MECHANISM
35
THERMAL
OVERLOAD
RELAY
23
MAGNETIC
AUTOMATIC
TRIP UNIT
25
10
11
14
15
16
17
18
19
20
21
22
24
26
27
28
29
30
32
33
34
36
37
38
41
42
43
44
45
46
47
48
49
99

UNITIZED COMBINATION STARTER

This invention relates to circuit interrupters in general and more particularly relates to a unitized combination motor starter having current limiting characteristics.

U.S. Pat. No. 4,088,973 issued May 9, 1978 to F. W. Kussy et al for a Unitized Combination Starter describes a circuit breaker in series with an electromagnetic contacter. The circuit breaker section includes a pivoted contact arm engageable with a single stationary contact and mounted so that under severe fault current conditions, electromagnetic blow-off effects will result in current limiting action.

U.S. Pat. No. 3,317,866 issued May 2, 1967 to T. Hanafusa for An Automatic Circuit Interrupter Having Magnetic Blow-off Means illustrates a circuit breaker construction wherein electrodynamic blow-off forces acting on a bridging contact are effective to create two circuit gaps for limiting current under severe fault conditions.

Pursuant to the instant invention a unitized combination starter is provided with a circuit breaker having a bridging contact engageable with a pair of spaced stationary contacts, and a contactor bridging contact engageable with another pair of spaced stationary contacts. The bridging contacts are arranged so that they are relatively close and parallel to one another when the combination starter is closed and currents flow through these bridging contacts in opposite directions. Upon the occurrence of severe fault conditions the oppositely directed currents flowing through the bridging contacts create an electrodynamic force which urges the bridging contacts in opposite directions toward their respective open circuit positions with this blow-off action taking place before the circuit breaker and/or contactor operating mechanisms are effective to bring about contact opening. Thus, in the circuit internal to the combination starter, four gaps are created almost instantaneously to limit the magnitude of severe fault currents thereby facilitating current interruption.

Accordingly, a primary object of the instant invention is to provide an improved circuit interrupter which is constructed to benefit from electrodynamic blow-off effects.

Another object is to provide an interrupter of this type constructed in the form of a unitized combination motor starter.

Still another object is to provide an interrupter of this type having independently operable opposed bridging contacts which are blown apart during the occurrence of severe fault current conditions.

A further object is to provide an interrupter having bridging contacts of this type which are engageable with separate sets of stationary contacts disposed in different closely spaced sections of the circuit through the interrupter.

These objects as well as other objects of this invention shall become readily apparent after reading the following description of the accompanying drawing in which the single FIGURE is a schematic illustration of a unitized combination starter constructed in accordance with teachings of the instant invention.

Circuit interrupter 10 is constructed in the form of a multipole combination motor starter only one pole of which is illustrated in the FIGURE. Interrupter 10 includes common insulating housing 11 to which the mechanical and current carrying elements are mounted. Disposed at the right side of housing 11 are line and load terminals 14, 15 disposed on the external side of insulating barrier 99. Wire grip 16, 17 mounted on the respective terminals 14, 15 are provided for connecting interrupter 10 in an external circuit. The current carrying path through interrupter 10 consists of line terminal 14, line terminal strap 18, stationary contact 19 mounted at the end of strap 18 remote from terminal 14, bridging contact 20, stationary contact 21, conducting strap 22, overload relay 23, conducting strap 24, magnetic automatic trip unit 25, conducting strap 26, stationary contact 27, bridging contact 28, stationary contact 29 and load terminal strap 30 to load terminal 15 at the end of strap 30 remote from stationary contact 29.

The ends of straps 18 and 22 bearing stationary contacts 19, 21, respectively, are coplanar as are the ends of straps 26 and 30 bearing the respective stationary contacts 27, 29. Relatively thin insulating sheet 32 separates the contact bearing ends of straps 18, 22 from the contact bearing ends of the respective straps 30, 26.

When in engagement with stationary contacts 19, 21, bridging contact 20 is biased rearwardly, or in contact closing direction, by coiled compression spring 33 which constitutes part of a collapsible link between circuit breaker bridging contact 20 and crossbar 34. The latter is connected by link 36 to spring powered toggle type contact operating mechanism 35 of a type well known to the circuit breaker art. Manual operating handle 37 for mechanism 35 projects forward of housing 11. Automatic trip unit 25 is connected by linkages 38 to mechanism 35 so that upon the occurrence of predetermined fault current conditions, mechanism 35 will automatically separate bridging contact 20 from stationary contacts 19, 21 by retracting link 36 to move bridging contact 20 forward. Upon contact separation, the arc drawn between contacts 19, 20 will move into parallel plate arc chamber 41 and in a similar manner the arc drawn between contacts 20, 21 will move into parallel plate arc chamber 42.

Coiled compression spring 43 constitutes part of a collapsible link connecting contactor bridging contact 28 to band 44. With bridging contact 28 engaging stationary contacts 27, 29, spring 43 provides contact pressure by biasing bridging contact 28 forward or in its closing direction. Band 44 is connected to the rear of movable magnetic armature 45 which is biased rearwardly, or in the contact opening direction, by tension springs 46, 47. Armature 45 is a generally U-shaped member having arms which extend into the openings of electromagnet operating coil 48 which is operatively connected to overload relay 23, in a manner well known to the motor controller art. When coil 48 is energized armature 45 is attracted forward toward stationary magnetic yoke 49 thereby driving bridging contact 28 into engagement with stationary contacts 27, 29. When coil 48 is deenergized, opening springs 46, 47 retract armature 45 thereby separating bridging contact 28 from movable contacts 27, 29.

Bridging contacts 20, 28 are generally parallel, are relatively close to one another and have oppositely directed currents flowing therethrough, so that under severe fault current conditions electrodynamic forces act to urge contacts 20, 28 away from one another in their contact opening directions. This occurs prior to operation of toggle mechanism 35 to open bridging contact 20 or deenergization of coil 48 to permit springs 46, 47 to open bridging contact 28. Thus, under severe overload conditions four gaps are created very quickly in the current path between terminals 14, 15 to severely limit the magnitude of the fault until mechanism 35 acts to move bridging contact 20 in its opening direction. Even though mechanism 35 moves contact 20, the let through energy will probably operate overload relay 23 to deenergize coil 48 so that springs 46, 47 are effective to move the other bridging contact 28 in its opening direction.

Overload relay 23 may be of a conventional construction having removable heaters which are replaceable from the front of relay 23. Similarly, housing 11 is constructed of a plurality of molded sections including a front cover which, when removed, permits access to the front of overload relay 23. Trip unit 25 may be provided with interchangeable coils which are removable and replaceable from the front after overload relay 23 is removed. Further, if desired, the positions of relay 23 and trip unit 25 may be exchanged so that relay 23 will be alongside of electromagnet 45, 47, 48 and trip unit will be adjacent contact operating mechanism 35.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A circuit interrupter including first and second terminals for connecting said interrupter in an external circuit, conductive elements extending between said terminals and defining an internal series circuit having first and second closely spaced elongated sections through which currents flow in opposite direction to generate electrodynamic forces urging said sections away from each other; said first section including stationary first and second contacts spaced along the length of said first section with a first gap therebetween, and a movable first bridging contact extending across said first gap; selectively operable first means for moving said first bridging contact into and out of engagement with said first and second contacts; and first biasing means connected to said first bridging contact to provide contact pressure at said first and second contacts while urging said first bridging contact toward said second section; said second section including stationary third and fourth contacts spaced along the length of said second section with a second gap therebetween, and a movable second bridging contact extending across said second gap; selectively operable second means for moving said second bridging contact into and out of engagement with said third and fourth contacts; second biasing means connected to said second bridging contact to provide contact pressure at said third and fourth contacts while urging said second bridging contact toward said first section; said first means including a first automatic trip device for causing said first means to disengage said first bridging contact from said first and second contacts responsive to detecting first predetermined fault current conditions; said second means including a second automatic trip device for causing said second means to disengage said second bridging contact from said third and fourth contacts responsive to detecting second predetermined fault current conditions; said first and second biasing means being proportioned so that upon the occurrence of severe overcurrent conditions electrodynamic forces acting in opposite directions on said first and second bridging contacts cause them to separate from the first, second, third and fourth contacts before either said first or second means is effective to open said interrupter.

2. A circuit interrupter as set forth in claim 1 also including a thin insulator disposed between the first and second bridging contacts.

3. A circuit interrupter as set forth in claim 1 constructed as a unitized structure.

4. A circuit interrupter as set forth in claim 1 in which the first means also includes a manually operable spring powered contact operating mechanism for moving the first bridging contact and the second means includes an electromagnetic operator for moving the second bridging contact.

5. A circuit interrupter as set forth in claim 4 in which the first automatic trip device is of the magnetic type and the second automatic trip device is of the thermal type.

6. A circuit interrupter as set forth in claim 5 for which said first predetermined fault current conditions are below said severe overcurrent conditions and greater than said second predetermined fault current conditions.

7. A circuit interrupter as set forth in claim 6 also including a thin insulator disposed between the first and second bridging contacts.

8. A circuit interrupter as set forth in claim 7 constructed as a unitized structure.

9. A circuit interrupter as set forth in claim 1 in which the first bridging contact is operable selectively by said first means into and out of engagement with said first and second contacts while said second bridging contact remains engaged with said third and fourth contacts.

10. A circuit interrupter as set forth in claim 9 in which circuit opening movement of the first bridging contact is in a first direction away from said second bridging contact and opening movement of the latter is in a second direction opposite to said first direction.

* * * * *